US008256073B2

(12) United States Patent
Zhang

(10) Patent No.: US 8,256,073 B2
(45) Date of Patent: Sep. 4, 2012

(54) HARNESS FASTENER SYSTEM FOR CHILD CARRIER DEVICE

(75) Inventor: Da Liang Zhang, Kowloon (HK)

(73) Assignee: BP Children's Products HK Co., Limited, Hong Kong (HK)

( * ) Notice: Subject to any disclaimer, the term of this patent is extended or adjusted under 35 U.S.C. 154(b) by 83 days.

(21) Appl. No.: 12/726,664

(22) Filed: Mar. 18, 2010

(65) Prior Publication Data

US 2010/0237112 A1 Sep. 23, 2010

(30) Foreign Application Priority Data

Mar. 20, 2009 (TW) ..... 98109217 A

(51) Int. Cl.
*A44B 11/25* (2006.01)
*A44B 11/26* (2006.01)
*A47D 13/02* (2006.01)

(52) U.S. Cl. ..... 24/634; 24/606; 24/635; 224/161; 297/468; 297/483

(58) Field of Classification Search ..... 24/631, 24/161, 614, 308, 177, 163 R, 182, 164, 633, 24/635, 664, 630, 634, 632, 637, 656, 657, 24/665; 224/161; 297/468, 483
See application file for complete search history.

(56) References Cited

U.S. PATENT DOCUMENTS

| | | | | |
|---|---|---|---|---|
| 2,629,156 | A * | 2/1953 | Kamens et al. | 24/657 |
| 3,793,858 | A * | 2/1974 | Jones | 70/457 |
| 3,825,979 | A * | 7/1974 | Jakob | 24/579.11 |
| 3,851,360 | A * | 12/1974 | Minolla | 24/656 |
| 4,001,923 | A * | 1/1977 | Frankel et al. | 24/665 |
| 4,742,604 | A * | 5/1988 | Mazelsky | 24/579.09 |
| 5,604,964 | A * | 2/1997 | Aoshima | 24/632 |
| 6,049,954 | A * | 4/2000 | Britto | 24/579.11 |
| 6,796,007 | B1 * | 9/2004 | Anscher | 24/633 |
| 6,983,518 | B2 * | 1/2006 | Chen | 24/636 |
| 7,360,287 | B2 * | 4/2008 | Cerruti et al. | 24/633 |
| 7,849,571 | B2 * | 12/2010 | Chen | 24/625 |
| 2004/0003486 | A1 * | 1/2004 | Dingman et al. | 24/177 |
| 2007/0044285 | A1 * | 3/2007 | Kawamura et al. | 24/633 |
| 2008/0010790 | A1 * | 1/2008 | Dillner | 24/630 |

FOREIGN PATENT DOCUMENTS

GB 2286851 A 8/1995

* cited by examiner

*Primary Examiner* — Robert J Sandy
*Assistant Examiner* — Louis Mercado
(74) *Attorney, Agent, or Firm* — David I. Roche; Baker & McKenzie

(57) ABSTRACT

A harness fastener system for a child carrier device comprises a first plug, and a buckle including a front surface and a release button. The first plug is movable along a first direction substantially parallel with the front surface for engaging with the buckle, and the release button is movable along a second direction substantially parallel with the front surface for pushing the first plug out of the buckle.

19 Claims, 8 Drawing Sheets

HARNESS FASTENER SYSTEM FOR CHILD CARRIER DEVICE

CROSS-REFERENCE TO RELATED APPLICATION

This application claims the benefit of priority to Taiwan Application No. 098109217, filed on Mar. 20, 2009.

FIELD OF THE INVENTION

The present invention relates to a harness fastener systems, and more specifically to harness fastener systems for child carrier devices.

DESCRIPTION OF THE RELATED ART

To comply with current safety regulations, commercialized child carrier devices must be equipped with a harness system for securely restraining the child positioned in the child carrier device. The harness usually comprises one or more straps that can be detachably locked with a buckle for restraining the seated child. In general, the buckle is unlocked by pressing a release button to disengage a plug (e.g., lap strap plug), which can then be removed out of the buckle. The release button can return to its resting position by insertion of a tongue of the plug. U.S. Pat. No. 6,711,790, the description of which is incorporated herein by reference, describes an example of such buckle design. However, owing to the placement of the release button, external pressure may be easily applied on the release button (e.g., the seated child may inadvertently press thereon), which may cause accidental unfastening of the harness.

Accordingly, there is a need for a harness fastener system that can address the foregoing issues and provide safer use.

SUMMARY

The present application describes a harness fastener system for a child carrier device that can address at least some of the foregoing issues.

According to some embodiment, the harness fastener system comprises a first plug, and a buckle including a front surface and a release button. The first plug is movable along a first direction substantially parallel with the front surface for engaging with the buckle, and the release button is movable along a second direction substantially parallel with the front surface for pushing the first plug out of the buckle.

In other embodiments, a child carrier device is described. The child carrier device comprises a seating area, a lap strap joined with a first plug, a shoulder strap joined with a second plug, and a crotch strap joined with a buckle, the buckle including a front surface and a release button. The first and second plugs are movable along a first direction substantially parallel with the front surface for engaging with the buckle, and the release button is movable along a second direction substantially parallel with the front surface for pushing the first and second plugs out of the buckle.

The foregoing is a summary and shall not be construed to limit the scope of the claims. The operations and structures disclosed herein may be implemented in a number of ways, and such changes and modifications may be made without departing from this invention and its broader aspects. Other aspects, inventive features, and advantages of the invention, as defined solely by the claims, are described in the non-limiting detailed description set forth below.

DETAILED DESCRIPTION OF THE EMBODIMENTS

Figure 1:
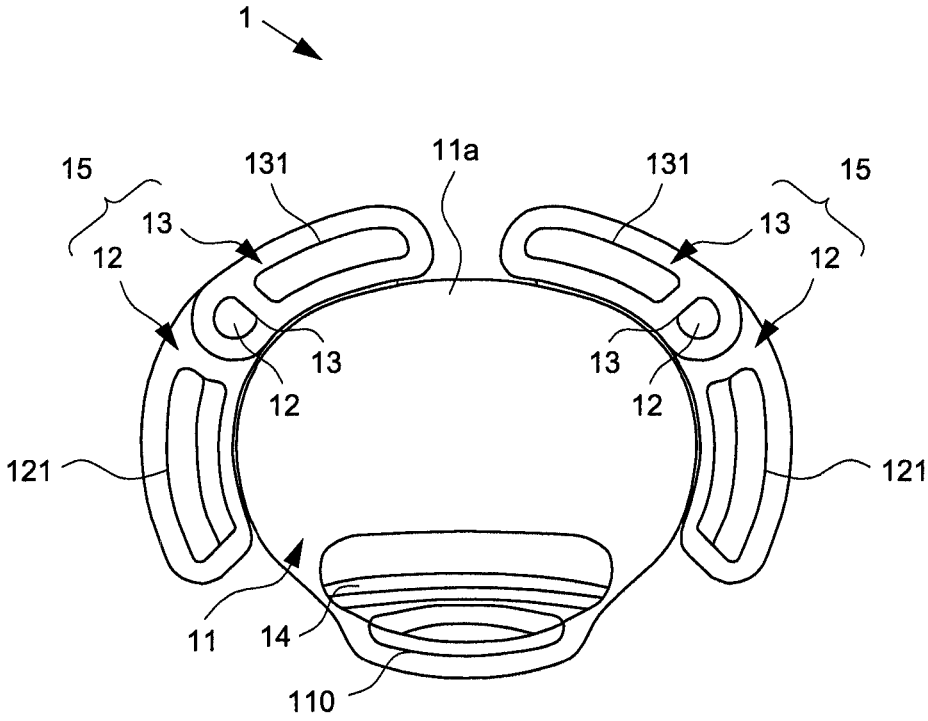
FIG. 1 is a front view illustrating one embodiment of a harness fastener system.
Figure 2:
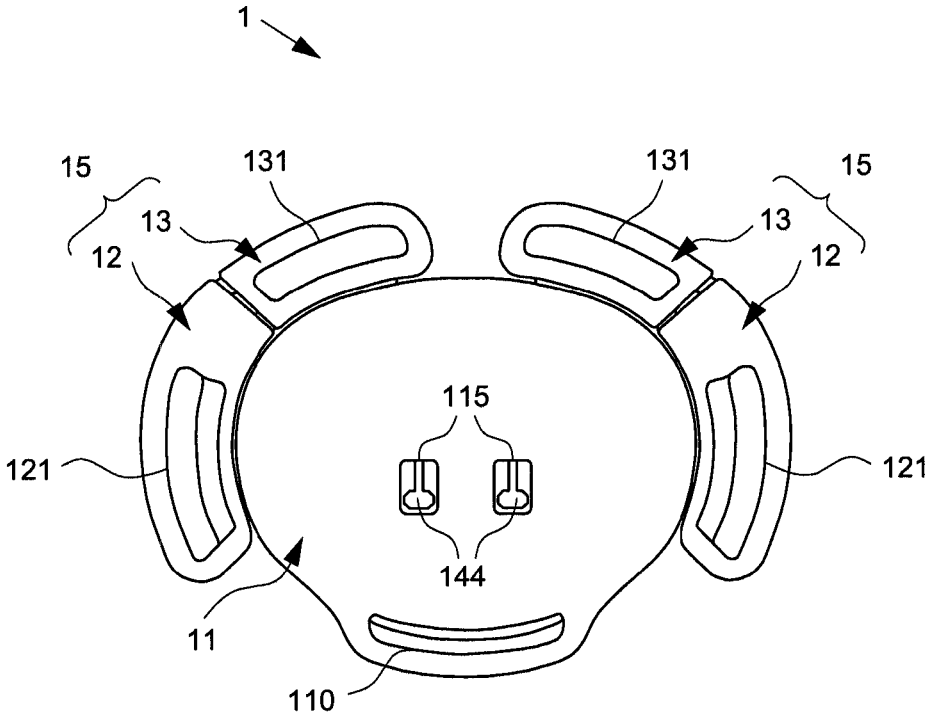
FIG. 2 is a rear view of the embodiment shown in FIG. 1.

FIGS. 1 and 2 are front and rear views showing one embodiment of a harness fastener system 1. The illustrated harness fastener system 1 can be exemplary used for implementing a 5-point harness comprising two lap straps, two shoulder straps and one crotch strap. However, it will be readily appreciated that the fastener system depicted herein can also be suitable for a 3-point harness including two lap or shoulder straps and one crotch strap. The terms "5-point harness" and "3-point harness" typically refer to the number of locations that the straps of the harness are attached to the seat for restraining a user. Examples of application for such harness fastener systems include, without limitation, child seats, high chairs and stroller devices.

As shown in FIGS. 1 and 2, the harness fastener system 1 comprises a buckle 11, two first plugs 12 for respectively coupling with distal ends of lap straps (not shown), and two second plugs 13 for respectively coupling with distal ends of shoulder straps (not shown). The buckle 11 has a front surface 11*a*, and a release button 14 accessible from the side of the front surface 11*a*. A peripheral region of the buckle 11 is also provided with a hole 110 for coupling the buckle 11 with a crotch strap (not shown). Each of the first plugs 12 includes a hole 121 for joining with the corresponding lap strap, and each of the second plugs 13 also includes a hole 131 for joining with the corresponding shoulder strap. Each first plug 12 can be connected and paired with one second plug 13 for forming a plug assembly 15 adapted to slide in a unitary block through the buckle 11 for locking engagement.

Figure 3:
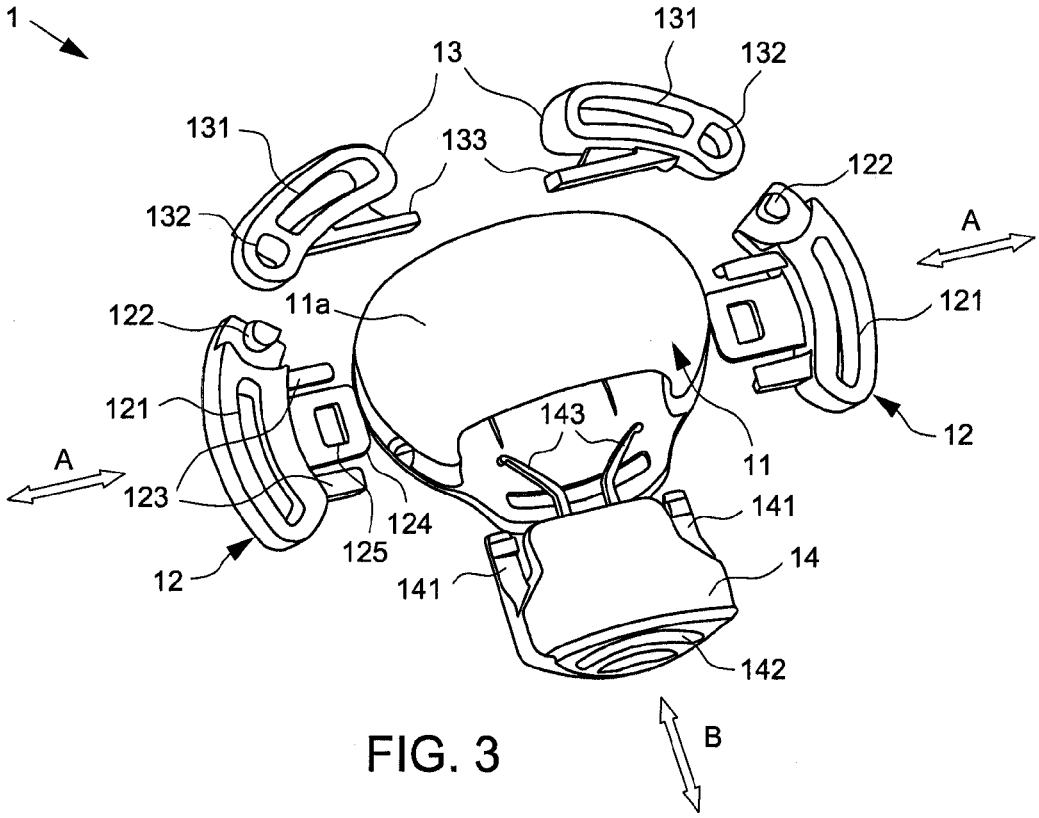
FIG. 3 is an exploded view of the harness fastener system.
Figure 4:
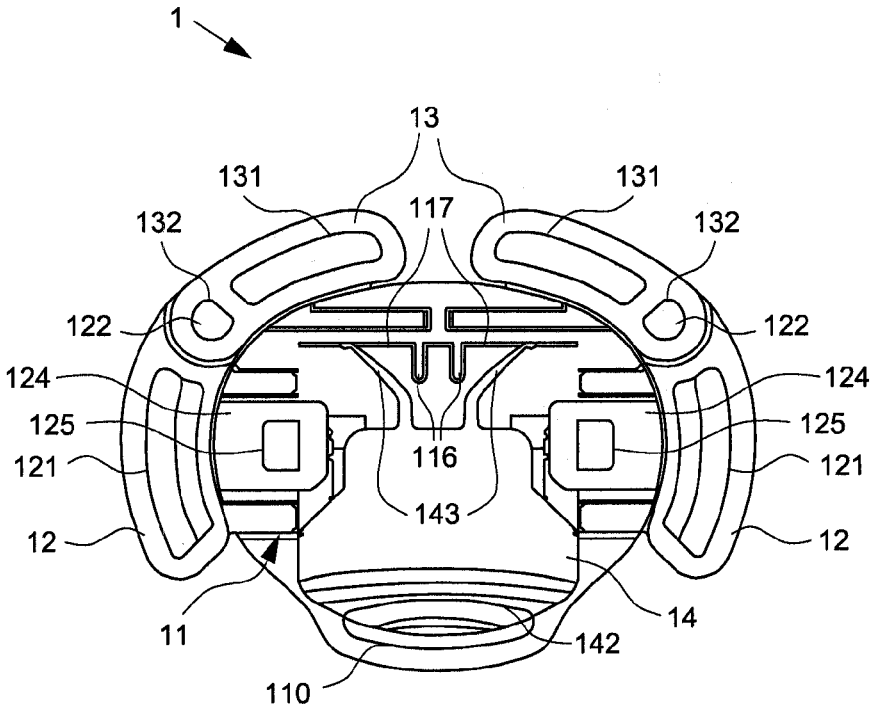
FIG. 4 is a schematic view showing an interior of the fastener system in a fastened state.

FIG. 3 is an exploded view of the harness fastener system 1, and FIG. 4 is a schematic view showing an interior of the fastener system 1 in a fastened state. As shown in FIGS. 3 and 4, each of the second plugs 13 has an opening 132 located proximate the hole 131. Correspondingly, each first plug 12 has an engaging m protrusion 122 having a shape matching with the opening 132 of the second plug 13. The plug assembly 15 can be formed by passing the engaging protrusion 122 of one first plug 12 through the opening 132 of one second plug 13, such that the paired plugs 12 and 13 are restrainedly coupled with each other. The connection region between the first plug 12 and the second plug 13 (i.e., corresponding to the engaging protrusion 122 of the first plug 12 and the opening 132 of the second plug 13) lies outside the buckle 11 when the paired plugs 12 and 13 insert through the buckle 11 for reducing the thickness of the harness fastener system. In one embodiment, the engaging protrusion 122 and opening 132 can have matched shapes adapted to block relative rotation movements between the paired plugs 12 and 13. The first plug 12 and second plug 13 can slide parallel with an axis A to fasten with or release from the buckle 11. In turn, the release button 14 can move along an axis B to disengage and push the first and second plugs 12 out of the buckle 11. The axes of movement A and B are approximately perpendicular to each other and parallel with the front surface 11*a* of the buckle 11.

Figure 5:
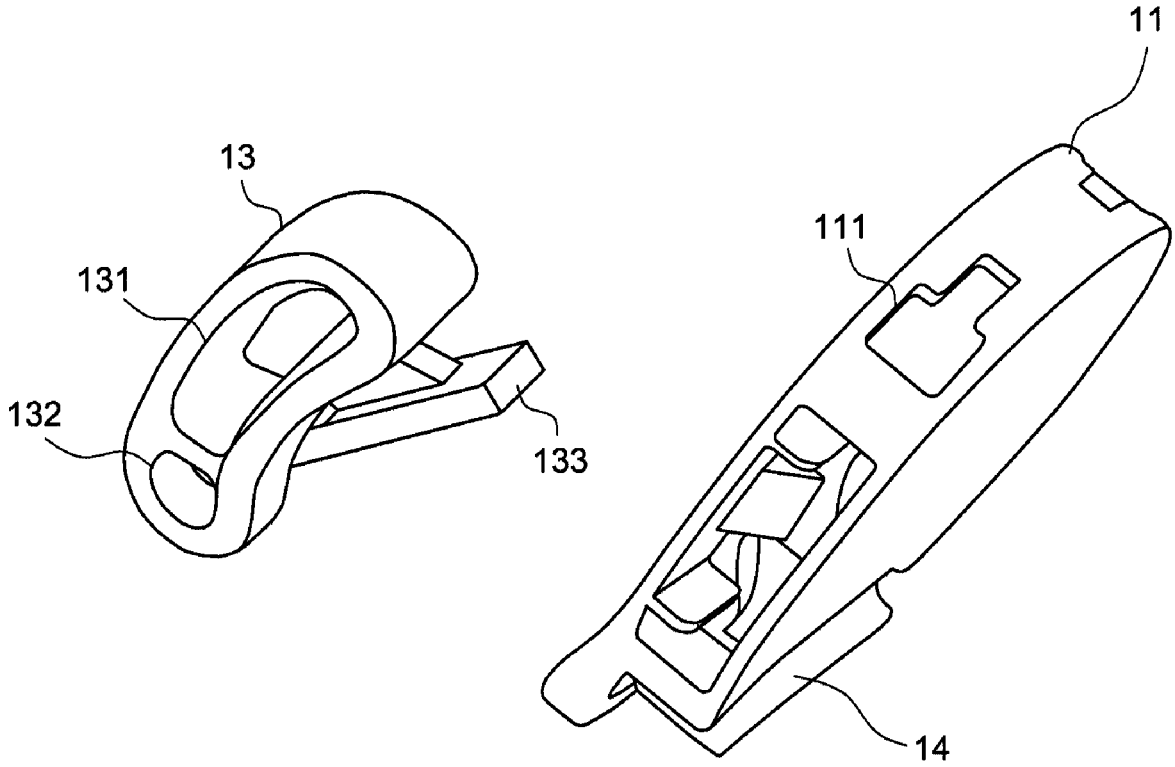
FIG. 5 is a schematic view illustrating the engagement of a buckle with a second plug of the fastener system.

FIG. 5 is a schematic view illustrating the engagement of the buckle 11 with the second plug 13. As shown, the second plug 13 can have an extending rib 133 protruding at one side of the plug 13. In one embodiment, the extending rib 133 can have a generally T-shaped section. Correspondingly, an outer lateral surface of the buckle 11 includes insertion slots 111 disposed symmetrical on left and right sides of an upper end of the buckle 11 (only one of the engaging slots 111 is visible on FIG. 5). Each of the two insertion slots 111 has a shape (e.g., T-shape) that can match with that of the engaging rib 133 for facilitating insertion of the second plug 13. Each of the second plug 13 can engage with the buckle 11 by insertion of the engaging rib 133 into the associated insertion slot 111.

Figure 6:
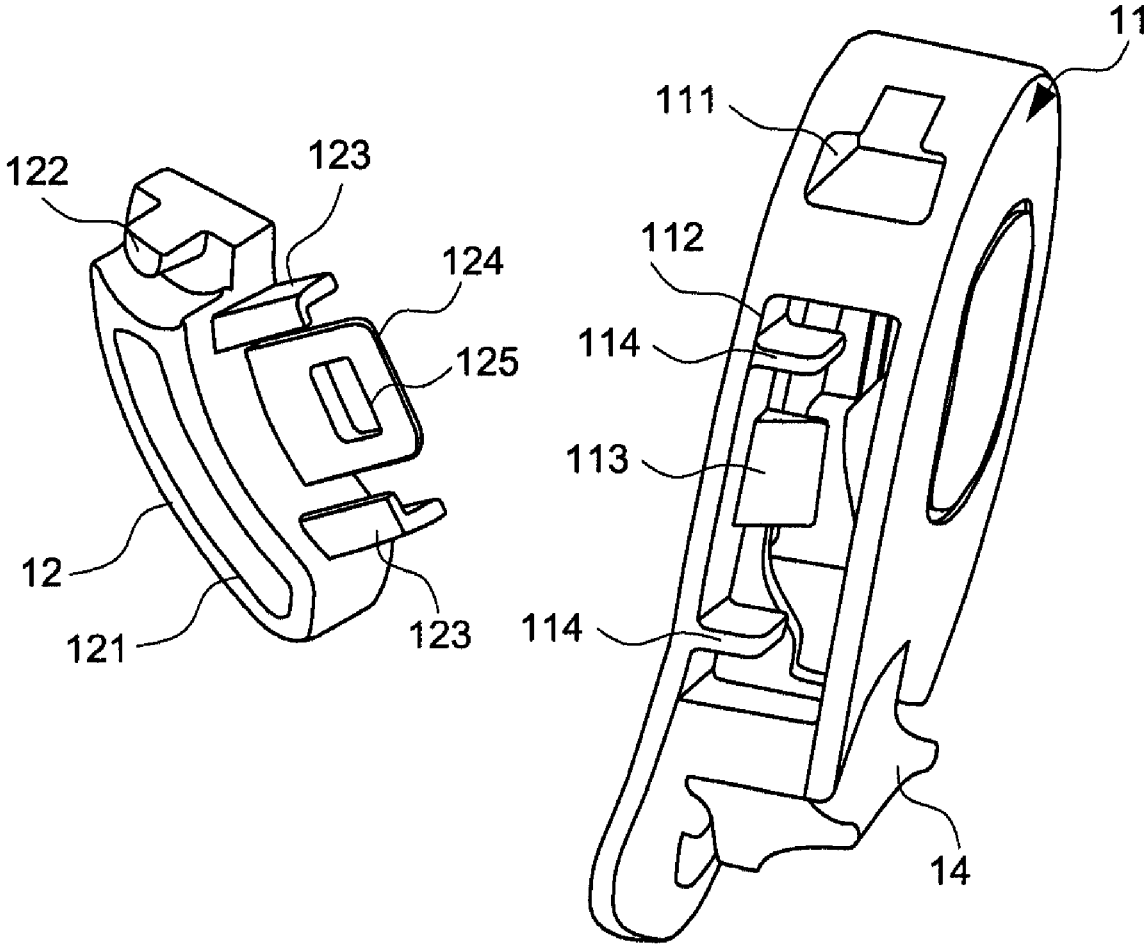
FIG. 6 is a schematic view illustrating the engagement of the buckle with a first plug of the fastener system.

FIG. 6 is a schematic view illustrating the engagement of the buckle 11 with the first plug 12. As shown in FIGS. 3, 4 and 6, each of the first plug 12 has guiding ribs 123 (e.g., in number of two), and a tongue portion 124 having an opening 125. In one embodiment, each of the guiding ribs 123 can be have a L-shape, respectively disposed on two opposite sides of the tongue portion 124. Correspondingly, the outer lateral surface of the buckle 11 has two insertion slots 112 disposed symmetrically on the left and right side of the buckle 11, respectively spaced apart from the insertion slots 111. An inner surface of each insertion slot 112 includes a latch element 113 formed as a protrusion having a tapered edge adapted to engage through the opening 125 of the tongue 124. The inner surface of the insertion slot 112 also includes a plurality of alignment ribs 114 for facilitating the insertion of the first plug 12 through the slot 112. When the first plug 12 is inserted in the buckle 11, the guiding ribs 123 can be aligned with the alignment ribs 114 to facilitate linear sliding of the plug 12 along the insertion slot 112. The first plug 12 can slide until the latch element 113 engages through the opening 125 of the tongue 124. In this manner, each of the first plugs 12 can be securely fastened with the buckle 11.

Figure 7:
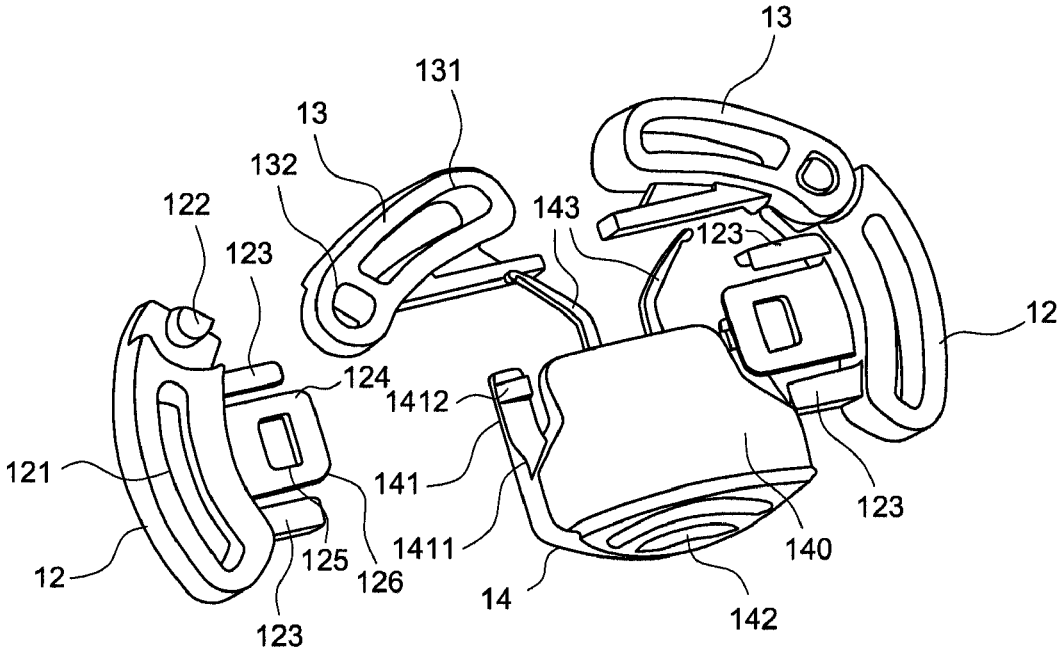
FIG. 7 is a schematic view illustrating the configuration of a release button in the fastener system.

FIG. 7 is a schematic view illustrating a structure of the release button 14. As shown in FIGS. 3, 4 and 7, the position of the release button 14 in the buckle 11 is located between the positions of the two first plugs 12. The release button 14 has a central portion 140, deflectable arms 141 respectively provided on two opposite lateral sides (i.e., left and right sides) of the central portion 140 and facing the first plugs 12, and a pad region 142 locate at a rear of the central portion 140. In one embodiment, each of the deflectable arms 141 can be made of a resilient material allowing deflection thereof upon application of an external force. Each of the deflectable arms 141 has a first driving surface 1412 and a second driving surface 1411 spaced apart from each other. The first and second driving surfaces 1412 and 1411 of each deflectable arm 141 are inclined according to different orientation, and are adapted to exert pushing actions on different locations of the tongue portion 124 for disengaging and ejecting the first plug 12 adjacent thereto. For example, the first driving surface 1412 can be formed on a protruding tab of each deflectable arm 141 tapered toward the corresponding slot 112, and located proximate the latch element 113. The second driving surface 1411 can be defined by a sloped surface on the deflectable arm 141 that faces obliquely the corresponding slot 112. When the release button 14 is pushed and moves toward the interior of the buckle 11, the first and second driving surfaces 1411 and 1412 can push against the underside of the tongue 124 of each first plug 12 for bending and unlatching the first plugs 12, and ejecting the first plugs 12 out of the buckle 11.

As shown in FIGS. 3, 4 and 7, a front end of the release button 14 also includes two resilient fingers 143 that can act as spring elements when being compressed against an inner sidewall 117 (FIG. 8) of the buckle 11. The resilient fingers 143 can be formed as forward extensions of the central portion 140. When the release button 14 is pushed toward the interior of the buckle 11 for unlocking the first plugs 12, the resilient fingers 143 can deform after abutment against the inner sidewall 117 of the buckle 11. When the external force applied on the release button 14 is removed, the resilient fingers 143 can resiliently push the release button 14 to recover its resting position. It is worth noting that alternate embodiments may also replace the resilient fingers 143 with separate spring parts that can be assembled with the central portion 140 of the release button 14.

Figure 8:
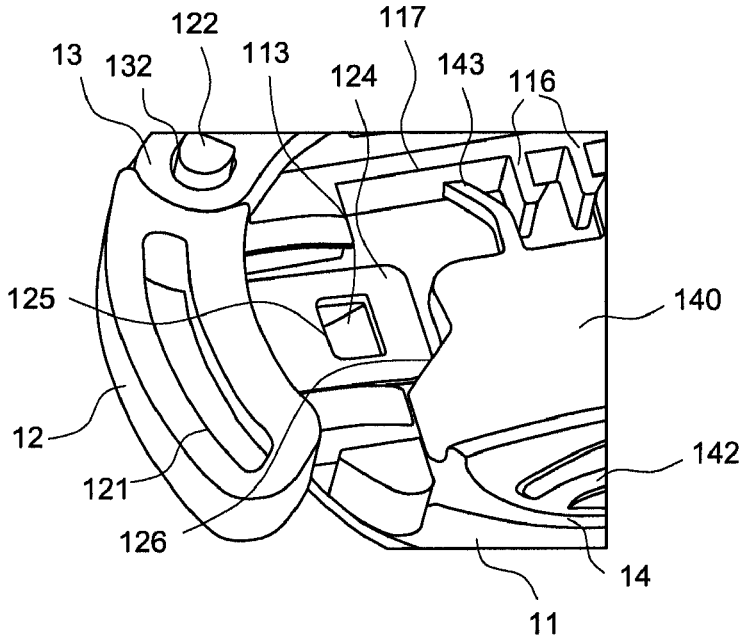
FIG. 8 is an enlarged view illustrating a fastening operation of the harness fastener system.

In conjunction with FIGS. 3 and 7, FIG. 8 is an enlarged view illustrating a fastening operation of the harness fastener system 1. First, each of the first plugs 12 is respectively coupled with one second plug 13 to form a plug assembly 15. As previously described, one first plug 12 can be restrainedly coupled with one second plug 13 by engaging the engaging protrusion 122 of the first plug 12 through the opening 132 on the second plug 13. Then, the plug assembly 15 can be inserted as a unitary block into the buckle 11, the first plug 12 and the second plug 13 being respectively aligned with the insertion slots 112 and 111. As the plug assembly 15 travels into the buckle 11, the tongue portion 124 of the first plug 12 may press against the latch element 113, causing slight upward deflection of the tongue portion 124. When the opening 125 of the tongue portion 124 reaches the position of the latch element 113, the tongue portion 124 can resiliently recover its initial shape and the latch element 113 can engage through the opening 125 of the tongue portion 124. The first plug 12 can be thereby locked with the buckle 11, while the second plug 13 can be retained inside the buckle 11 via its restrained connection with the first plug 12. In this fastened state, the first driving surface 1412 on the corresponding arm 141 of the release button 14 lies at least partially under the tongue portion 124 on the same side as the latch element 113, whereas the second driving surface 1411 is located proximate to an outer edge 126 of the tongue portion 124.

Figure 9:
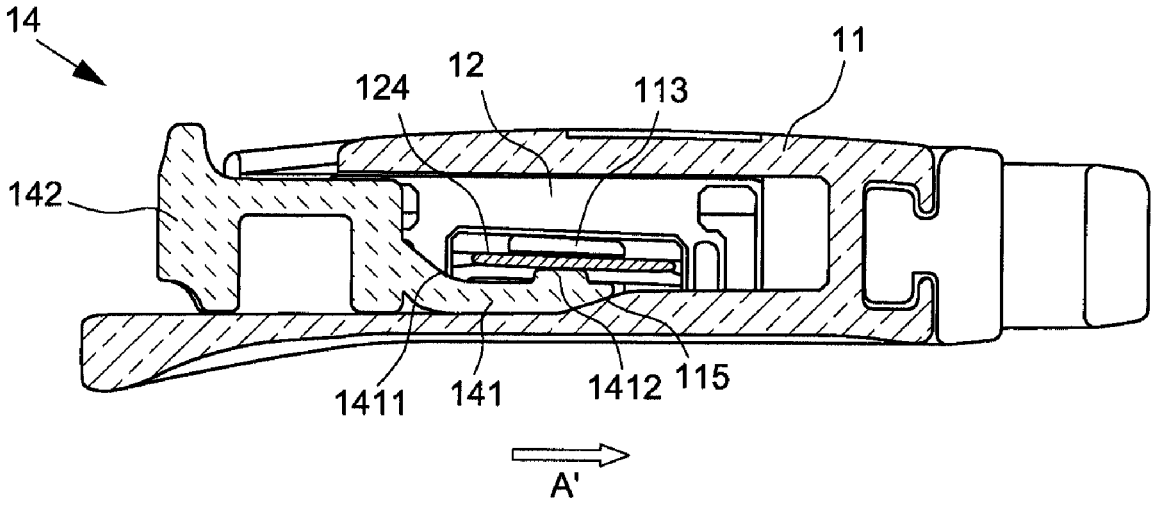
FIG. 9 is a cross-sectional view illustrating the unfastening operation of the harness fastener system.
Figure 10:
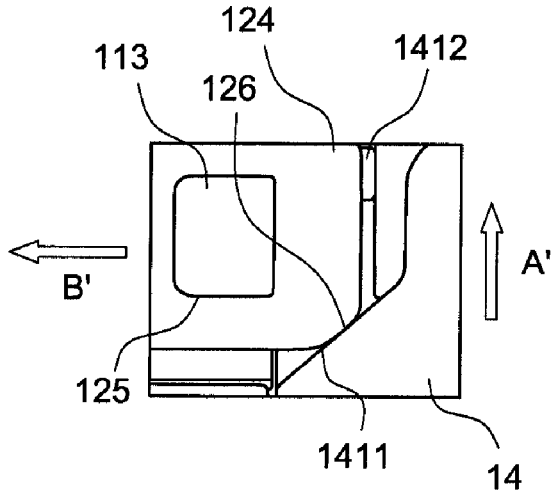
FIG. 10 is a partially enlarged view illustrating an unfastening operation of the harness fastener system.

FIGS. 9 and 10 are respectively cross-sectional and partially enlarged views illustrating an unfastening operation of the harness fastener system 1. When a user wants to unfasten the plug assembly 15, a pushing action may be applied on the pad region 142 of the release button 14 in the direction A' to cause the release button 14 to move toward the interior of the buckle 11. As the release button 14 slides in the direction A', the resilient fingers 143 can deform by abutment against the inner sidewall 117 of the buckle 11, and the two deflectable arms 141 are pushed against inclined surfaces 115 formed on a bottom surface of the buckle 11, which causes resilient deflection of the arms 141 toward the respective tongues 124 located adjacent thereto.

Accordingly, the first driving surface 1412 of each deflectable arm 141 can push against a region of the adjacent tongue portion 124 peripheral to the opening 125 in a direction substantially perpendicular to the front surface 11*a* of the buckle 11, and cause the tongue portion 124 to deflect in a direction that disengages the opening 125 from the latch element 113. As the release button 14 continues to move in the direction A', the second driving surface 1411 of each arm 141 can then push against an outer edge 126 of the adjacent tongue portion 124, which urges the first plug 12 and the second plug 13 restrainedly coupled therewith to eject in the direction B' out of the buckle 11. With the combined actions exerted by the first and second driving surfaces 1412 and 1411 of the release button 14, all the first and second plugs 12 and 13 can thus be unlatched and ejected out of the buckle 11 in a concurrent manner.

When the pushing force applied on the release button 14 is removed, the resilient fingers 143 can push against the inner sidewall 117 to cause the release button 14 to move in a reverse direction and restore its initial resting state. As shown in FIG. 8, limiting ribs 116 may protrude from the inner sidewall 117 in the buckle 11 to limit the extent of movement of the release button 14 toward the interior of the buckle 11. Rupture of the resilient fingers 143 owing to excessive push on the release button 14 can be thereby prevented.

Figure 11:
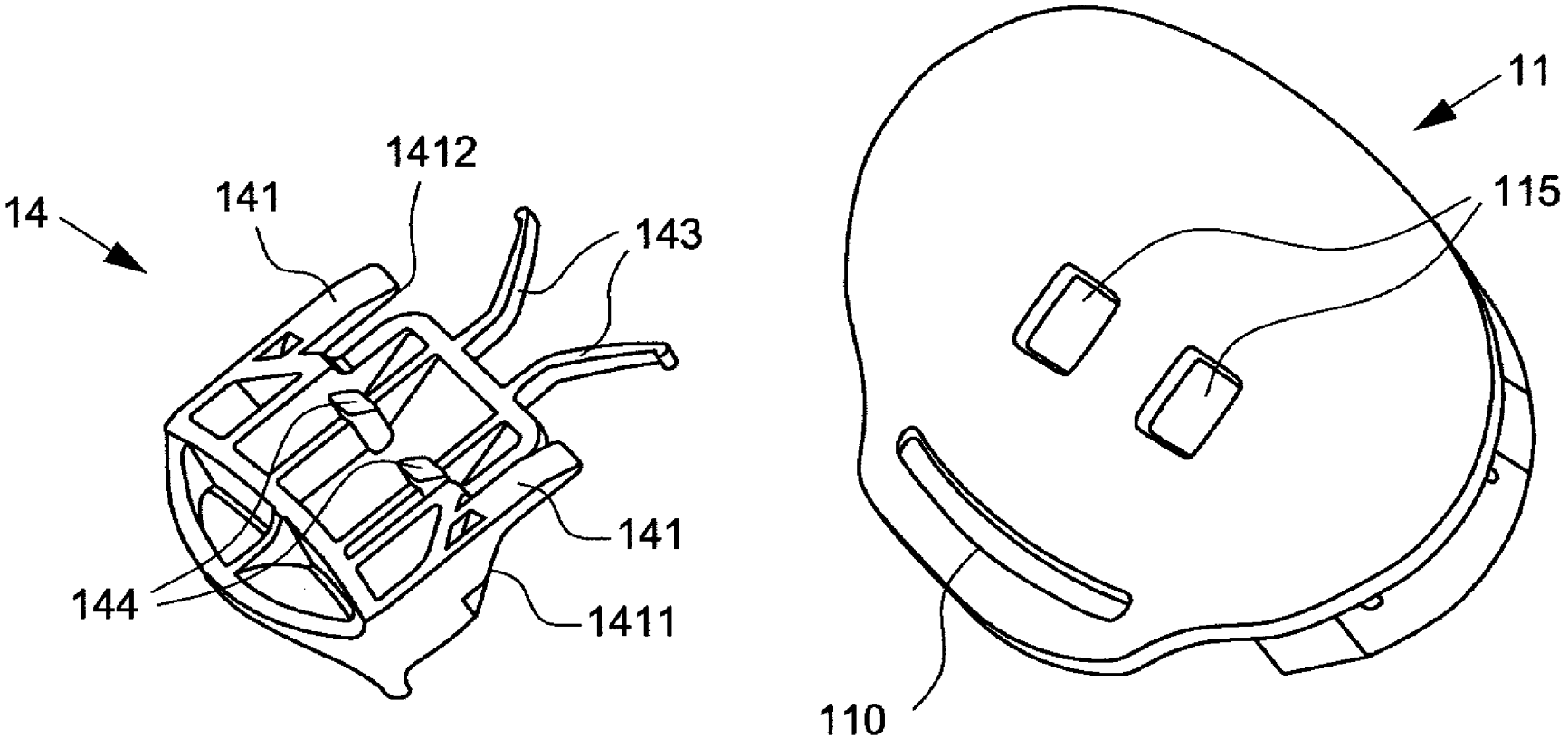
FIG. 11 is a schematic view showing a bottom side of the release button.

FIG. 11 is a schematic view showing a bottom side of the release button 14. In order to prevent separation of the release button 14 from the buckle 11, two pegs 144 may protrude from a bottom of the release button 14 and engages through corresponding holes 115 provided on a rear of the buckle 11 (as also shown FIG. 2).

Figure 12:
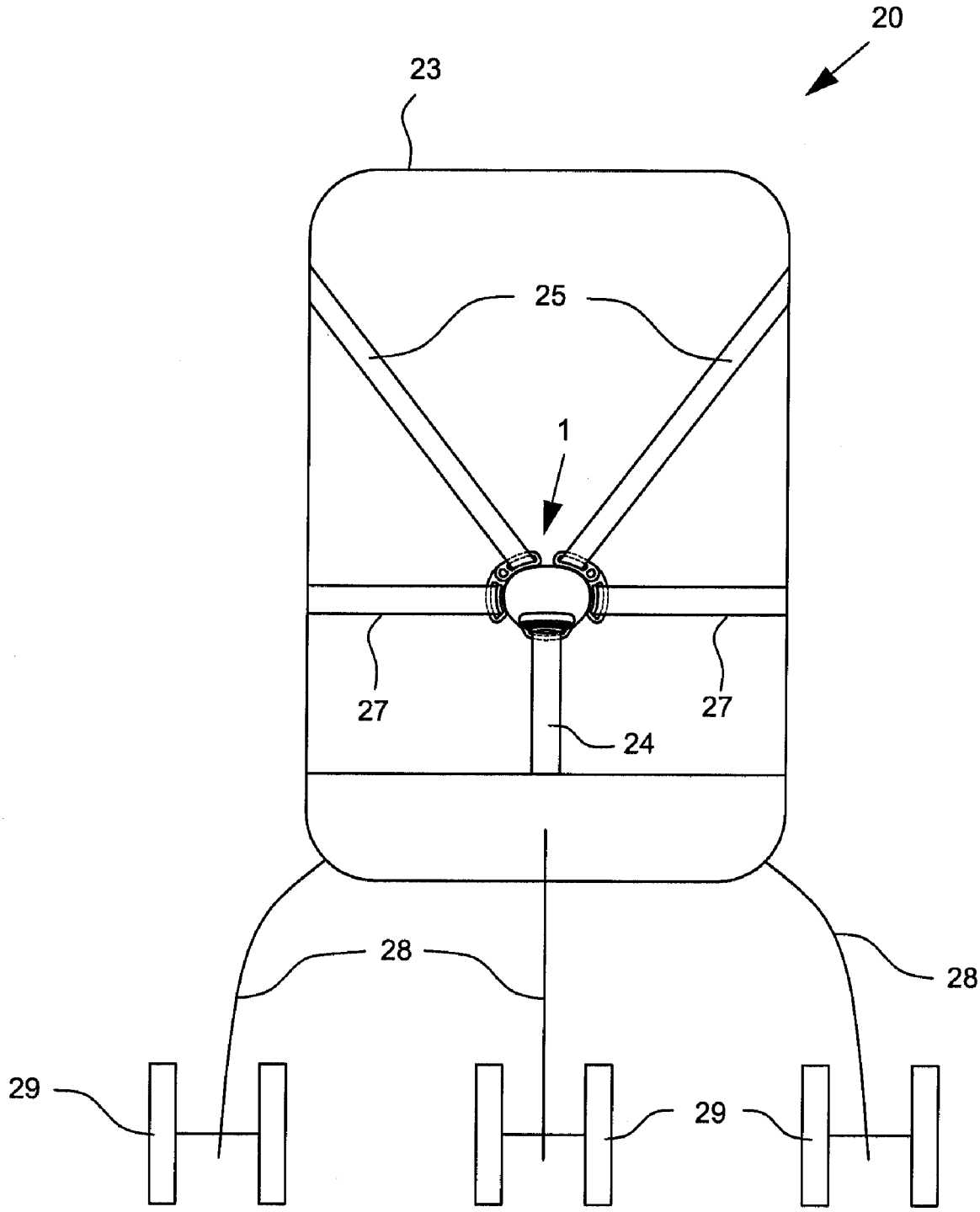
FIG. 12 is a schematic diagram illustrating one implementation of the harness fastener system in a child carrier device.

The fastener system described herein can be used in the harness of any seating structures, such as child seats, high chairs, strollers, etc. FIG. 12 is a schematic diagram illustrating one implementation of the harness fastener system 1 in a child carrier device 20. The child carrier device 20 can exemplary be a stroller comprising a carrier structure 23 having a seat area, a harness comprising a crotch strap 24, shoulder straps 25 and lap straps 27, and wheels 29 mounted on supporting legs 28 connected to a bottom of the carrier structure 23. A distal end of the crotch strap 24 can be adjoined with the buckle 11. A distal end of each shoulder strap 25 can be adjoined with one second plug 13. A distal end of each lap strap 27 can be adjoined with one first plug 12. When a child is seated in the child carrier device 20, the crotch strap 24, shoulder straps 25 and lap straps 27 can be securely attached via the fastener system 1 for achieving a 5-point harness.

At least one advantage of the fastener system and method described herein is the ability to lock and unlock the harness in a convenient manner. Multiple plugs 12 and 13 on a same side of the harness may be connected together to form a plug assembly 15, which can be conveniently engaged as one unitary block with the buckle 11 via a one-step operation. The unfastening operation can also be achieved by a single push on the release button 14 of the buckle 11, which can drive disengagement and ejection of all of the plugs 12 and 13 in a concurrent manner. Because the direction of movement of the release button 14 for unlocking the buckle 11 and the direction of movement for inserting or removing the plugs 12 and 13 are substantially parallel to the front surface of the buckle 11, inadvertent pressure on the release button 14 is less likely to occur. Therefore, accidental unfastening of the buckle can be prevented, and the harness fastener system is thus safer in use. Moreover, because the buckle 11 is provided with distinct plug insertion slots, the fastener system 1 can also be adapted for use with a 3-point harness. In this case, each first plug 12 can engage through the insertion slot 112 of the buckle 11 without second plugs 13.

Realizations in accordance with the present invention have been described in the context of particular embodiments. These embodiments are meant to be illustrative and not limiting. Many variations, modifications, additions, and improvements are possible. Accordingly, plural instances may be provided for components described herein as a single instance. Structures and functionality presented as discrete components in the exemplary configurations may be implemented as a combined structure or component. These and other variations, modifications, additions, and improvements may fall within the scope of the invention as defined in the claims that follow.

What is claimed is:

1. A harness fastener system for a child carrier device, comprising:

a first plug adapted to join with a first strap;

a buckle including a front surface and a release button, wherein the first plug engages with the buckle by moving the first plug along a first direction substantially parallel with the front surface, and the release button pushes the first plug out of the buckle by moving the button along a second direction substantially parallel with the front surface; and a second plug adapted to join with a second strap, wherein the second plug is operable to engage through the buckle restrainedly coupled with the first plug by moving the second plug with the first plug along the first direction, and ejection of the first plug drives the second plug out of the buckle.

2. The harness fastener system according to claim 1, wherein the first plug comprises a tongue portion that engages with a latch element in the buckle when the first plug is inserted through the buckle.

3. The harness fastener system according to claim 2, wherein the release button comprises at least one deflectable arm disposed at one lateral side of the release button that is proximate to the latch element.

4. The harness fastener system according to claim 3, wherein a movement of the release button for disengaging the first plug presses the deflectable arm against an inclined surface in the buckle, causing the deflectable arm to push the tongue portion out of engagement with the latch element.

5. The harness fastener system according to claim 4, wherein a first driving surface of the deflectable arm pushes the tongue portion out of engagement with the latch element in a direction substantially perpendicular to the front surface of the buckle.

6. The harness fastener system according to claim 4, wherein the first direction and the second direction are approximately perpendicular to each other, and the movement of the release button for disengaging the first plug causes a second driving surface of the deflectable arm to push the tongue portion in a direction that forces ejection of the first plug from the buckle.

7. The harness fastener system according to claim 1, wherein the first and second plug insert through two slots of the buckle that are spaced apart from each other.

8. The harness fastener system according to claim 1, wherein the first plug is configured to join with a lap strap, the second plug is configured to join with a shoulder strap, and the buckle is configured to join with a crotch strap.

9. The harness fastener system according to claim 1, wherein the release button further comprises a resilient finger extending approximately along the second direction, the resilient finger being operable to push the release button a reverse direction opposite to the second direction once a pushing action applied thereon is removed.

10. A child carrier device comprising:

a seating area;

a lap strap joined with a first plug;

a shoulder strap joined with a second plug; and a crotch strap joined with a buckle, the buckle including a front surface and a release button;

wherein the first and second plugs engage with the buckle by moving along a first direction substantially parallel with the front surface, and the release button pushes the first and second plugs out of the buckle by moving along a second direction substantially parallel with the front surface.

11. The child carrier device according to claim 10, wherein the first and second plugs are adapted to restrainedly couple with each other.

12. The child carrier device according to claim 10, wherein the first plug comprises a tongue portion that engages with a latch element in the buckle when the first plug is inserted through the buckle.

13. The child carrier device according to claim 12, wherein the release button comprises at least one deflectable arm disposed at one lateral side of the release button that is proximate to the latch element.

14. The child carrier device according to claim 13, wherein a movement of the release button for disengaging the first and second plugs presses the deflectable arm against an inclined surface in the buckle, causing the deflectable arm to push the tongue portion out of engagement with the latch element.

15. The child carrier device according to claim 14, wherein a first driving surface of the deflectable arm pushes the tongue portion out of engagement with the latch element in a direction substantially perpendicular to the front surface of the buckle.

16. The child carrier device according to claim 14, wherein the first direction and the second direction are approximately perpendicular to each other, and the movement of the release button for disengaging the first and second plugs causes a second driving surface of the deflectable arm to push the tongue portion in a direction that forces ejection of the first plug from the buckle.

17. The child carrier device according to claim 16, wherein the first and second plugs when inserted in the buckle are restrainedly coupled with each other, and ejection of the first plug drives the second plug out of the buckle.

18. The child carrier device according to claim 10, wherein the first and second plug insert through two slots of the buckle that are spaced apart from each other.

19. The child carrier device according to claim 10, wherein the release button further comprises a resilient finger extending approximately along the second direction, the resilient finger being operable to push the release button a reverse direction opposite to the second direction once a pushing action applied thereon is removed.

* * * * *